United States Patent [19]

Albright et al.

[11] Patent Number: 4,533,143

[45] Date of Patent: Aug. 6, 1985

[54] APPARATUS FOR RANDOM NUMBER SELECTION

[75] Inventors: Ronald G. Albright; William D. Albright, both of Canton, Ohio

[73] Assignee: Fork, Inc., New Philadelphia, Ohio

[21] Appl. No.: 628,386

[22] Filed: Jul. 6, 1984

[51] Int. Cl.[3] ..... A63F 3/06; A63F 9/04

[52] U.S. Cl. ..... 273/144 B; 273/145 C

[58] Field of Search ..... 273/144 B, 144 R, 145 C, 273/145 R, 1 L

[56] References Cited

U.S. PATENT DOCUMENTS

| | | | |
|---|---|---|---|
| 497,726 | 5/1893 | Phelps | 273/144 B |
| 1,538,455 | 5/1925 | Winkel | 273/145 C |
| 1,592,813 | 7/1926 | Whitney | 273/145 C |
| 2,074,207 | 3/1937 | Bracewell | 273/145 R |
| 2,103,151 | 12/1937 | Dietrich | 273/144 B X |
| 2,185,366 | 1/1940 | Bartholomew | 273/144 B |
| 2,296,001 | 9/1942 | Slattery | 273/145 C |
| 3,940,142 | 2/1976 | Hinz et al. | 273/145 C X |
| 4,273,335 | 6/1981 | Allonsius | 273/144 B |
| 4,323,770 | 4/1982 | Dieulot et al. | 235/375 |
| 4,373,728 | 2/1983 | Korzenietz | 273/144 R |
| 4,403,775 | 9/1983 | Chaput | 273/144 B |
| 4,444,394 | 4/1984 | Pasquine | 273/144 B |

FOREIGN PATENT DOCUMENTS

| | | | |
|---|---|---|---|
| 486343 | 11/1953 | Italy | 273/144 B |

*Primary Examiner*—Paul E. Shapiro

*Attorney, Agent, or Firm*—Michael Sand Co.

[57] ABSTRACT

A portable hand held apparatus for randomly selecting by chance a plurality of numbers particularly suitable for lottery selections. A plurality of buoyant cubes are contained in the fluid tight generally opaque container. The container has a window for viewing a predetermined number of the cubes temporarily trapped and arranged adjacent the window after agitating the container by a user. A cube receiving channel is formed within the container adjacent the window for releasably trapping a desired number of cubes adjacent the window. The fluid and buoyant cubes provide a pleasing movement of the cubes within the container when agitated by the user and randomly come to rest adjacent the viewing window.

8 Claims, 5 Drawing Figures

APPARATUS FOR RANDOM NUMBER SELECTION

TECHNICAL FIELD

The invention relates to a device for randomly selecting a plurality of numbers for use in lotteries where the participant is allowed to pick his own number.

BACKGROUND ART

An increasing number of states are conducting lotteries in which the participants select their own number which if it matches the numbers drawn in the lottery with result in the awarding of prizes, usually a predetermined amount of money. In many of these lotteries, the participants have to make a relatively large number of selections, for example, in the state of Ohio, the participant makes a selection of six numbers out of a possible forty for a single ticket at a predetermined price. The numbers range consecutively from 1 to 40.

The requirement of making such a high number selection presents difficulties as well as intrigue to a majority of the participants. Many people use the dates of special occasions, such as birthdays, social security numbers, addresses, or the like. Other participants develop complicated mathematical systems based upon past winning numbers, astrological determinations and the like. Whereas other participants devise means of randomly selecting such numbers entirely by chance.

Various devices have been developed for providing a random selection of a predetermined number for use by participants such as numbered balls which move through various apertures in an enclosed chamber and into a viewing area. Examples of such prior devices are shown in U.S. Pat. Nos. 4,273,335; 4,373,728; and 4,403,775. Although these devices do provide a device for randomly selecting a number for the participant, it is believed that our device provides an intriguing means of selecting such a number which provides increased mystigue to the element of chance for the user.

DISCLOSURE OF THE INVENTION

Objectives of the invention include providing an improved apparatus for the random selection of numbers primarily for use in playing a lottery, in which a plurality of buoyant dies or cubes are located within a fluid filled container which after being agitated by the user will randomly trap a predetermined number of the cubes in an elongated sequence adjacent a viewing window for visual inspection by the user. A further objective is to provide such an apparatus in which the fluid preferably is distilled water and the cubes are formed of a high strength urethane or other plastic material which floats, and in which preferably four or more sides of the cubes are marked with a predetermined numeral so that all of the numerals in the desired sequence are represented an equal number of times on the cubes.

A still further objective of the invention is to provide such an apparatus in which the fluid tight container preferably is formed of plastic and has a removable end cap which enables the device to be shipped free of fluid and subsequently filled by the purchaser of the apparatus with water or other desired fluid after placing the numbered cubes within the container, and in which the removable end cap which seals the filled container is provided with an inwardly extending projection which assists in displacing some of the fluid within the container to prevent the formation of air bubbles by trapped air within the container.

A still further objective of the invention is to provide such an apparatus in which a channel is molded integrally on the inner side wall of the container and has a width complementary to that of the cubes so as to removably trap and hold the cubes within the channel after agitation of the apparatus by a user for viewing through the window, and in which the container preferably is opaque except for the transparent viewing area which extends in a horizontal elongated fashion along the length of the container which preferably is cylindrical.

Another objective is to provide such a device in which the cubes appear to be suspended within the fluid providing a mystique to the device as opposed to numbered balls or the like which move freely within an enclosed container as in prior devices, further adding to the enjoyment and element of chance of the user. A still further objective of the invention is to provide such an apparatus in which the fluid can be dyed various colors to provide a pleasing color contrast with the buoyant cubes within the container, and in which the cubes are hidden from the participants within the container until the predetermined number of cubes are trapped within the channel adjacent the viewing window. Another objective of the invention is to provide such an apparatus preferably containing forty, six sided, cubes in which each cube has the same numeral printed on at least four of the sides and in which forty cubes are numbered consecutively from 1 thru 40.

Another objective is to provide such an apparatus which is portable and is easily carried by the user so as to be used at any location, and which is extremely light weight and fits easily within the palm of the user's hand and provides the random number in seconds after the container is agitated and cubes permitted to float to an at-rest position. Furthermore, the device provides a relatively inexpensive, rugged and durable apparatus which achieves the desired advantages.

These objectives and advantages are obtained by the improved apparatus of the invention for random number selection, the general nature of which may be stated as including: a fluid tight container; a fluid generally filling the container; a plurality of buoyant indicia bearing members contained in the fluid within the container; window means provided in the container for viewing a predetermined number of the indicia bearing members coming to rest and arranged adjacent said window means after agitation of the members within the container; and channel means located within the container adjacent the window means for receiving and positioning the predetermined number of indicia bearing members adjacent said window means for viewing by a user of said apparatus.

BRIEF DESCRIPTION OF THE DRAWINGS

A preferred embodiment of the invention, illustrative of the best mode in which applicants have contemplated applying the principle, is set forth in the following description and is shown in the drawings and is particularly and distinctly pointed out as set forth in the appended claims.

Similar numerals refer to similar parts throughout the drawings.

BEST MODE FOR CARRYING OUT THE INVENTION

Figure 1:
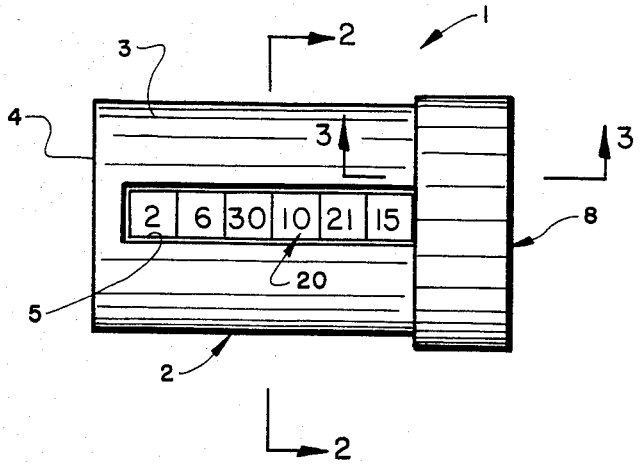
FIG. 1 is a plan view of the improved apparatus with six of the numbered cubes being arranged in viewing position adjacent the viewing window.

The improved apparatus is indicated generally at 1, and is shown in FIG. 1 in plan view. Apparatus 1 includes a preferably cylindrical shaped container, indicated generally at 2, formed by a cylindrical side wall 3 and an integrally connected circular end wall 4. Container 2 preferably is molded of plastic or similar material and is fluid tight and has an opaque covering surface except for an elongated rectangular shaped transparent window area 5.

Figure 3:
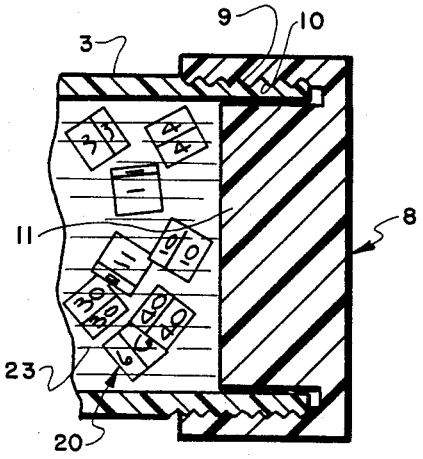
FIG. 3 is an enlarged fragmentary sectional view taken on line 3—3, FIG. 1.
Figure 4:
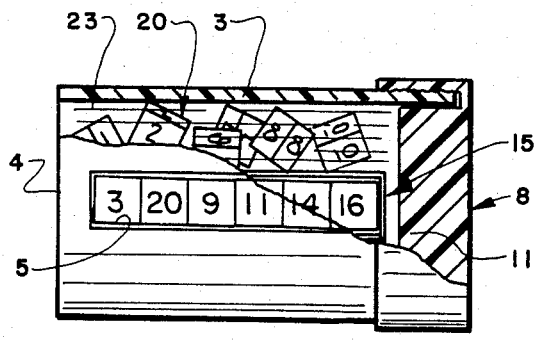
FIG. 4 is a plan view similar to FIG. 1 with portions broken away and in section.

The opposite end of container 2 from end wall 4 is open as indicated in FIG. 3 and is closed by a removable end cap, indicated generally at 8. End cap 8 is threadably engaged with an exterior threaded end portion 9 formed on the open end of cylindrical side wall 3. Cap 8 has a cylindrical configuration and is formed with an inner threaded portion 10 which engages threaded portion 9 of side wall 3. End cap 8 also is provided with an annular inwardly extending projection 11 which extends into the interior of container 2 when cap 8 is threadably mounted on the outer end of container wall 3.

Figure 2:
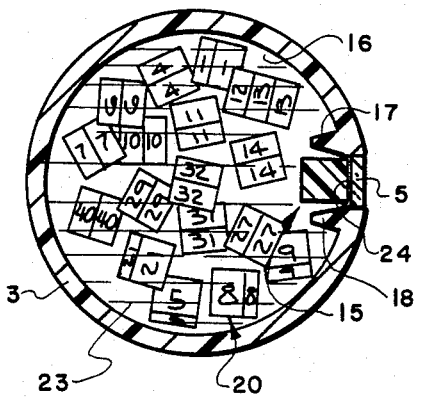
FIG. 2 is an enlarged sectional view taken on line 2—2, FIG. 1.
Figure 5:
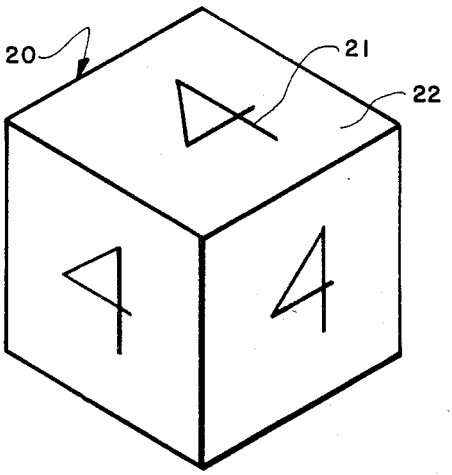
FIG. 5 is an enlarged perspective view of one of the numbered cubes.

In accordance with one of the main features of the invention, an interior channel indicated generally at 15 (FIG. 2), is formed integrally with and located within hollow interior 16 of container 2 and extends generally throughout the longitudinal length of container 2. As shown in FIG. 2, channel 15 may be formed by a pair of parallel spaced channel forming projections 17 and 18 which are molded integrally with cylindrical side wall 3. Channel 15 has a transverse width generally equal to the width of each of the numbered cubes, indicated generally at 20 and shown in FIG. 5, which are contained within container 2. Channel 15 also has a predetermined length generally equal to the total length of the required number of cubes which are to be placed in juxtaposition with respect to each other. In the particular embodiment shown, six cubes are shown.

The particular number combination devised by the particular state for its lottery will determine the number of cubes placed within container 2. In the embodiment shown, which is directed to the lottery for the State of Ohio, forty cubes 20 are placed within the container since the lottery requires that the participant select six numbers from a series of numbers from 1 thru 40. Each cube 20 is six sided formed of equal square surfaces. Cubes 20 preferably are formed of a high strength urethane, plastic, wood or other material which will float.

A numeral indicated at 21 preferably is placed on at least four of the individual sides 22 of each cube 20, although this numeral preferably is placed on all six sides thereof. Also, the same numeral preferably is placed on each cube with a single cube being used for each of the respective numbers of the sequence. Therefore, in the embodiment shown, which has forty cubes, each cube will represent one of the numbers.

Apparatus 1 preferably is of a relatively compact size, for example, having a length of approximately 3 inches and a diameter of approximately 2½ inches and is easily hand held and operated by the user thereof. Cubes 20 preferably will be ⅜ inch square. To use the device, an individual will merely rotate, shake, or agitate in some manner the cubes which are floating in the container in a fluid 23. Permitting the cubes to come to rest will enable six of the cubes to float into and be trapped by channel 15 with one of the cube faces being adjacent a flat inner surface 24 of window 5. The user will be unable to see any of the cubes moving within the interior of the container due to the opaque covering thereof until the random six cubes arranged themselves adjacent the viewing window where they are immediately and easily visible to the user. If desired, the user will use these six numbers for his lottery ticket selection or can again agitate the cubes until a number appears at the window that he feels may be the winning number combination.

Preferably the improved apparatus will be shipped to a purchaser in a dry state, that is, without fluid 23 being within the container to reduce shipping costs and weight. Threaded removable end cap 8 enables the ultimate purchaser to fill the container with fluid 23 after placing the required number of cubes 20 therein. The user upon tightening cap 8 on side wall 3 will force excess fluid 23 from within the hollow interior 16 by projection 11 of end cap 8. This helps eliminate any air from being trapped within container 2 reducing the formation of air bubbles which could restrict the floating movement of cubes 20.

Preferably fluid 23 is distilled water although other types of liquids can be used. Also the water can have various dyes added thereto for providing a different color effect to the liquid medium in which the cubes float. Also cubes 20 can be of various materials depending upon the particular liquid used in order to provide the desired floating action. Although container 2 is shown as being cylindrical, other configurations can be used without affecting the concept of the invention. Furthermore, channel 15 may have other shapes than that shown in the drawings in order to satisfactorily trap and locate the predetermined number of cubes adjacent the viewing window. Likewise, end cap 8 may be attached to the open end of side wall 3 by other means than the threaded connection shown and could actually be formed integrally therewith providing a hermetically sealed container containing the cubes and fluids.

Accordingly, the improved apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved apparatus for the random selection of numbers is constructed and used, the characteristics of the construction, and the advantageous, new and useful results obtained; the new and useful structures, devices, elements, arrangements, parts, and combinations, are set forth in the appended claims.

What is claimed is:

1. A portable, hand held and manipulated apparatus for the random selection of numbers including:

(a) a cylindrical-shaped fluid tight container formed by an opaque cylindrical side wall and a pair of end walls;

(b) a fluid generally filling the container;

(c) a plurality of buoyant cubes having printed numerals on certain sides of the cubes contained in the fluid within the container;

(d) a rectangular-shaped transparent window provided in the side wall of the container and extending generally parallel with a longitudinal axis of said cylindrical-shaped container for viewing the printed numerals on a predetermined number of the cubes coming to rest and arranged in juxtaposition to each other and located adjacent said window after agitation of the cubes within the container by manually shaking the container; and (e) an elongated channel located within the container and aligned with the window, said channel being formed by a pair of spaced projections formed integral with the cylindrical side wall and projecting inwardly into the interior of the container, said channel having a transverse width complementary to the width of the cubes and a length complementary to the total length of said predetermined member of juxtapositioned cubes whereby only the predetermined number of cubes are received within the channel and positioned adjacent the window for viewing by a user of said apparatus after agitation of the cubes within the container, with said agitation being assisted by the channel forming projections.

2. The apparatus defined in claim 1 in which one of the end walls is formed integral with the side wall; and in which the other end wall is a removable cap located opposite of said integral wall.

3. Apparatus defined in claim 2 in which the end cap is threadably mounted on the end of the cylindrical side wall.

4. Apparatus as defined in claim 3 in which the removable end cap has projection means extending into the interior of the container when mounted thereon for displacing a portion of the fluid to expel any trapped air from within said container.

5. The apparatus defined in claim 1 in which the channel has a length complementary to the total length of six of the cubes in order to removably hold and present six randomly retained cubes adjacent the window.

6. Apparatus as defined in claim 1 in which the cubes are formed of urethane.

7. Apparatus as defined in claim 1 in which forty cubes are contained in the container; and in which said cubes have forty numerals printed thereon sequenced 1 thru 40 with each of the cubes bearing the same numeral on each of the marked sides thereof with a respective one of the cubes bearing a respective one of the forty numerals.

8. Apparatus as defined in claim 1 in which the cube sides are $\frac{3}{8}$ inch square.

* * * * *